United States Patent [19]

Hirozawa

[11] 4,012,541

[45] Mar. 15, 1977

[54] METHOD FOR WETTING HYDROPHOBIC DIAPHRAGMS FOR USE IN CHLOR-ALKALI CELLS

[75] Inventor: Stanley T. Hirozawa, Birmingham, Mich.

[73] Assignee: BASF Wyandotte Corporation, Wyandotte, Mich.

[22] Filed: Oct. 1, 1975

[21] Appl. No.: 618,446

[52] U.S. Cl. ..... 427/243; 427/296; 427/307; 427/353

[51] Int. Cl.[2] ..... B05D 1/18; C25B 13/08

[58] Field of Search ..... 204/296; 427/430 R, 427/419, 243, 244, 336, 352, 296, 307, 353, 245

[56] References Cited

UNITED STATES PATENTS

| | | | |
|---|---|---|---|
| 2,773,114 | 12/1956 | McAuslan | 204/296 X |
| 3,010,536 | 11/1961 | Plurien et al. | 427/244 X |
| 3,772,072 | 11/1973 | Brown et al. | 427/244 X |
| 3,772,269 | 11/1973 | Lew | 252/8.9 X |
| 3,904,496 | 9/1975 | Harke et al. | 204/296 X |
| 3,930,979 | 1/1976 | Vallance | 204/296 X |

*Primary Examiner*—James R. Hoffman
*Attorney, Agent, or Firm*—John W. Linkhauer; Bernhard R. Swick; Robert E. Dunn

[57] ABSTRACT

Hydrophobic diaphragm material, such as crystalline, highly expanded microporous polytetrafluoroethylene film, may be prepared for installation in a chlor-alkali cell by a process involving the steps of (1) immersing the diaphragm in a solution of acetal-type nonionic surfactant in a suitable non-aqueous solvent, (2) rinsing the diaphragm in deionized water, (3) immersing the diaphragm in an aqueous solution containing an amount of acetal-type nonionic surfactant effective to promote wetting for a suitable period of time, and (4) immersing the diaphragm in a brine solution containing about 100 to 200 grams per liter of sodium chloride and an amount effective to promote wetting of an acetal-type nonionic surfactant for a suitable period of time, such as several hours. In some instances, it is also advantageous to subject the diaphragm while immersed in the solvent solution to the action of a vacuum, to release trapped air.

29 Claims, No Drawings

METHOD FOR WETTING HYDROPHOBIC DIAPHRAGMS FOR USE IN CHLOR-ALKALI CELLS

BACKGROUND OF THE INVENTION

1. Field of the Invention

This invention relates to the art of operating cells that are used for the electrolysis of brine to produce chlorine and caustic, and in particular to such cells wherein a diaphragm divides the cell into anolyte and catholyte portions, with the diaphragm being of relatively hydrophobic material such as highly crystalline polytetrafluoroethylene. It concerns a method for preparing a diaphragm for use before its insertion into such a cell, and in particular, it concerns adequately wetting the diaphragm prior to use.

2. Description of the Prior Art

The operation of diaphragm-type electrolytic cells to produce caustic and chlorine is well known to those skilled in the art. Although it has been usual to use asbestos for diaphragms of such cells, there has recently been a trend to change to different diaphragm materials, such as crystalline polytetrafluoroethylene, because of the considerable occupational-hazard problems encountered in the manufacture of asbestos and the expense of meeting them. The crystalline polytetrafluoroethylene material is quite satisfactory as a diaphragm material, except for its drawback of being rather hydrophobic and consequently tending to be difficult to wet, or tending to dewet while in service. Although, in operating with very small cells on a laboratory scale, it is convenient to use acetone as a means of wetting a highly crystalline polytetrafluoroethylene diaphragm, such a practice is not useful with respect to the wetting of a large or moderately large diaphragm, of the kind that is encountered in a pilot-plant or commercial-scale unit. Acetone is volatile, and it often escapes before the diaphragm is completely installed. It is known that other means are required in order to solve the problems thereby presented, and the published patents concerning the use of polytetrafluoroethylene as a diaphragm material in the manufacture of caustic and chlorine by the electrolysis of brine do not present any particular solutions to the problem above-indicated.

SUMMARY OF THE INVENTION

Hydrophobic diaphragm material, such as crystalline, highly expanded microporous polytetrafluoroethylene film, may be prepared for installation in a chlor-alkali cell by a process involving the steps of (1) immersing the diaphragm in a solution of acetal-type nonionic surfactant in a suitable non-aqueous solvent, (2) rinsing the diaphragm in deionized water, (3) immersing the diaphragm in an aqueous solution containing an amount of acetal-type nonionic surfactant effective to promote wetting for a suitable period of time, and (4) immersing the diaphragm in a brine solution containing about 100 to 200 grams per liter of sodium chloride and an amount effective to promote wetting of an acetal-type nonionic surfactant for a suitable period of time, such as several hours. In some instances, it is also advantageous to subject the diaphragm while immersed in the solvent solution to the action of a vacuum, to release trapped air.

DESCRIPTION OF THE PREFERRED EMBODIMENTS

The present invention concerns a method for wetting diaphragms, so that they may be used in a chlor-alkali process, the diaphragms being of substantial size and being of hydrophobic nature, such as diaphragms made of crystalline polytetrafluoroethylene or the like. The problems are increased if the diaphragm to be used is of laminated nature. According to the invention, the first step in preparing a diaphragm of substantial size for use in a chlor-alkali cell, if the diaphragm is of crystalline polytetrafluoroethylene or some other material of relatively hydrophobic nature, is to immerse the diaphragm in a solution which contains on the order of 0.005 to 0.5 weight percent of an appropriate acetal-type nonionic-surfactant material, such as a $C_8$ to $C_{14}$ alkyl glycoside, decyl glycoside being a good example, dissolved not in water, but in a suitable non-aqueous medium, such as a medium selected from the group consisting of 2-propanol, n-propanol, ethanol, and methanol. The solvent contains an amount of such surfactant effective to promote wetting of the diaphragm. The immersion may take place at atmospheric pressure, and in most circumstances, an immersion of a few minutes is sufficient. Preferably, the immersion occurs at ambient temperature, but temperatures somewhat higher or lower may be used if desired.

Suitable acetal-type nonionic surfactants include not only the decyl glycoside mentioned above but also n-octyl glycoside,
2-ethylhexyl glycoside,
n-nonyl glycoside,
undecyl glycoside,
dodecyl glycoside,
tridecyl glycoside, and
tetradecyl glycoside.

If desired, or if necessary, the solution containing the diaphragm may be subjected to vacuum treatment, to help to dislodge air trapped in the diaphragm. This step is especially advantageous if the diaphragm is laminated. A vacuum on the order of 100 millimeters of mercury absolute pressure or less may be used. Conveniently, a vacuum of sufficient quality may be produced with the use of an aspirator.

The next step in the preparation of a diaphragm, according to the invention, for use in a chlor-alkali cell is the rinsing of the diaphragm in deionized water.

A further step in the preparation of the diaphragm, according to the invention, is the immersion of the diaphragm in an aqueous solution containing an amount effective to promote wetting, such as 0.005 to 1.5, preferably about 0.1 weight percent, of an acetal-type nonionic surfactant, for example, decyl glycoside or another of the list mentioned above. An appropriate decyl glycoside composition may be made in the manner indicated in U.S. Pat. No. 3,772,269. This immersion may take place for a suitable length of time, such as 5 minutes to 5 days, but satisfactory results have been obtained with the use of a time on the order of 30 minutes.

Following the immersion in aqueous decyl glycoside or the like, the diaphragm is preferably immersed in a brine solution containing a substantial proportion of such acetal-type surfactant, such as a brine containing 100 to 200 grams per liter of sodium chloride and 0.5 to 5 percent, preferably 0.5 to 1.5 percent, by weight of acetal-type nonionic surfactant, such as decyl glycoside. The length of time in this immersion step is not critical, except that the time should be at least 3 hours, and preferably for several hours or overnight. The diaphragm may be stored indefinitely in such a surfactant-containing brine, prior to its installation in the electrolytic cell.

With the diaphragm-preparation method indicated above, it is possible to obtain a diaphragm of substantial size which will remain adequately wetted despite the passage of a considerable length of time, for example, 20 or 40 minutes, such as is likely to elapse between when a membrane is withdrawn from a wetting solution and when its installation in a chlor-alkali cell has been completed and it is in service, in contact with a brine which should maintain it in an adequately wetted condition. For the purposes of this invention, a diaphragm having an area greater than 0.5 square meters may be considered as being of substantial size. The invention is, of course, equally applicable to the prewetting of diaphragms smaller than that, especially in circumstances in which considerable time elapses between withdrawal from the storage solution and completion of the installation, e.g., in the construction of a filter-press cell having many units.

The invention described above is illustrated by the following specific examples.

EXAMPLE 1

A diaphragm of crystalline, highly expanded microporous polytetrafluoroethylene is prepared for use in a chlor-alkali cell. The diaphragm is immersed in 2-propanol to which there has been added 0.01 percent by weight of decyl glycoside. Thereafter, the diaphragm is subjected to vacuum treatment with the use of an aspirator to remove entrapped air, and following vacuum treatment, the diaphragm is rinsed in deionized water. The diaphragm is then immersed in a 0.1 weight percent aqueous solution of decyl glycoside for approximately 30 minutes, and then the diaphragm is immersed in a brine containing 160 grams per liter of sodium chloride and containing one percent by weight of decyl glycoside for 10 hours. Finally, the diaphragm is inserted into a chlor-alkali cell for the electrolysis of brine, and it serves satisfactorily.

EXAMPLE 2

Example 1 is repeated, except that in place of 2-propanol, n-propanol is used, and the results are substantially the same.

EXAMPLE 3

Example 1 is repeated, except that ethanol is used in place of 2-propanol, and the results are substantially the same.

EXAMPLE 4

Example 1 is repeated, except that methanol is used in place of 2-propanol, and the results are substantially the same.

EXAMPLE 5

Example 1 is repeated, except that the vacuum treatment was omitted, and the results are substantially the same.

EXAMPLE 6

Example 1 is repeated, except that dodecyl glycoside is used in place of decyl glycoside, not only in the 2-propanol but also in the aqueous solution and in the brine. The results are substantially the same.

EXAMPLE 7

Example 1 is repeated, except that for the initial treatment in 2-propanol, there is used a 2-propanol solution containing 0.2 percent by weight of decyl glycoside. Moreover, in the step concerning the use of the aqueous surfactant composition, the immersion takes place for 60 minutes instead of 30, and there is used 0.08 percent by weight of nonyl glycoside. In the final step, the diaphragm is immersed in a brine containing 170 grams per liter of sodium chloride and containing 3 percent of decyl glycoside. The diaphragm is installed in a cell and performs satisfactorily.

While there have been shown and described herein certain embodiments of the invention, it is intended that there be covered as well any change or modification therein which may be made without departing from the spirit and scope of the invention.

The embodiments of the invention in which an exclusive property or privilege is claimed are defined as follows:

1. A method of preparing for use in a chlor-alkali cell a diaphragm of crystalline, highly expanded microporous polytetrafluoroethylene film, said method comprising the steps of immersing said diaphragm in a solution in a solvent selected from the group consisting of 2-propanol, n-propanol, ethanol and methanol, and containing an amount of an acetal-type nonionic surfactant effective to promote wetting of said diaphragm, rinsing said diaphragm in deionized water, immersing said diaphragm in an aqueous solution of an acetal-type nonionic surfactant under conditions of surfactant concentration and time effective to promote wetting of said diaphragm, and immersing said diaphragm in a solution of brine containing 100 to 200 grams per liter of sodium chloride and an amount effective to promote wetting of said diaphragm of acetal-type nonionic surfactant, for a period of time of at least three hours, and then installing said diaphragm in a chlor-alkali cell.

2. A method as defined in claim 1, wherein said acetal-type nonionic surfactant is a $C_8$ to $C_{14}$ glycoside.

3. A method as defined in claim 2, wherein said acetal-type nonionic surfactant is decyl glycoside.

4. A method as defined in claim 1, wherein said solvent is 2-propanol.

5. A method as defined in claim 4, wherein said acetal-type nonionic surfactant is a $C_8$ to $C_{14}$ glycoside.

6. A method as defined in claim 5, wherein said acetal-type nonionic surfactant is decyl glycoside.

7. A method as defined in claim 1, characterized in that said solvent contains 0.005 to 0.5 weight percent of said acetal-type nonionic surfactant.

8. A method as defined in claim 7, wherein said acetal-type nonionic surfactant is a $C_8$ to $C_{14}$ glycoside.

9. A method as defined in claim 8, wherein said acetal-type nonionic surfactant is decyl glycoside.

10. A method as defined in claim 7, wherein said solvent is 2-propanol.

11. A method as defined in claim 10, wherein said acetal-type nonionic surfactant is a $C_8$ to $C_{14}$ glycoside.

12. A method as defined in claim 11, wherein said acetal-type nonionic surfactant is decyl glycoside.

13. A method as defined in claim 1, wherein the step of immersing said diaphragm in an aqueous solution of acetal-type nonionic surfactant is done in a solution containing 0.005 to 1.5 percent by weight of said surfactant for a period of time of from 5 minutes to 5 days.

14. A method as defined in claim 13, wherein said acetal-type nonionic surfactant is a $C_8$ to $C_{14}$ glycoside.

15. A method as defined in claim 14, wherein said acetal-type nonionic surfactant is decyl glycoside.

16. A method as defined in claim 13, wherein said solvent is 2-propanol.

17. A method as defined in claim 16, wherein said acetal-type nonionic surfactant is a $C_8$ to $C_{14}$ glycoside.

18. A method as defined in claim 17, wherein said acetal-type nonionic surfactant is decyl glycoside.

19. A method as defined in claim 13, characterized in that said solvent contains 0.005 to 0.5 weight percent of said acetal-type nonionic surfactant.

20. A method as defined in claim 19, wherein said acetal-type nonionic surfactant is $C_8$ to $C_{14}$ glycoside.

21. A method as defined in claim 20, wherein said acetal-type nonionic surfactant is decyl glycoside.

22. A method as defined in claim 19, wherein said solvent is 2-propanol.

23. A method as defined in claim 22, wherein said acetal-type nonionic surfactant is $C_8$ to $C_{14}$ glycoside.

24. A method as defined in claim 23, wherein said acetal-type nonionic surfactant is decyl glycoside.

25. A method as defined in claim 1, wherein said solution of brine contains 0.5 to 5 weight percent of said acetal-type nonionic surfactant.

26. A method as defined in claim 25, wherein said acetal-type nonionic surfactant is a $C_8$ to $C_{14}$ glycoside.

27. A method as defined in claim 26, wherein said acetal-type nonionic surfactant is decyl glycoside.

28. A method as defined in claim 27, wherein said solvent is 2-propanol.

29. A method as defined in claim 28, characterized in that said solvent contains 0.005 to 0.5 weight percent of said acetal-type nonionic surfactant.

* * * * *